United States Patent [19]

Thomas et al.

[11] Patent Number: 4,555,606

[45] Date of Patent: Nov. 26, 1985

[54] AIR FLOW SYSTEM FOR COMMON CAVITY OVEN

[75] Inventors: Calvin J. Thomas, Orefield; James E. Hurley, Allentown, both of Pa.

[73] Assignee: Raytheon Company, Lexington, Mass.

[21] Appl. No.: 632,517

[22] Filed: Jul. 19, 1984

[51] Int. Cl.[4] ..... H05B 6/72

[52] U.S. Cl. ..... 219/10.55 R; 219/10.55 F; 219/10.55 M; 219/400; 126/21 A

[58] Field of Search ..... 219/10.55 R, 10.55 F, 219/10.55 E, 10.55 M, 10.55 A, 10.55 D, 391, 393, 398, 399, 400; 126/21 A, 21 R, 1 R

[56] References Cited

U.S. PATENT DOCUMENTS

| | | | |
|---|---|---|---|
| 3,310,046 | 3/1967 | Scott et al. | 219/393 X |
| 3,366,769 | 1/1968 | Lima | 219/10.55 |
| 3,511,958 | 5/1970 | Staats | 219/10.55 |
| 3,529,582 | 9/1970 | Hurko et al. | 126/21 A |
| 3,936,627 | 2/1976 | Fitzmayer | 219/10.55 F |
| 4,028,520 | 6/1977 | Torrey | 219/10.55 B |
| 4,132,878 | 1/1979 | Tachikawa et al. | 219/10.55 B |
| 4,163,894 | 8/1979 | Scherer | 219/393 X |
| 4,314,127 | 2/1982 | Weiss | 219/10.55 F |

*Primary Examiner*—Philip H. Leung
*Attorney, Agent, or Firm*—William R. Clark

[57] ABSTRACT

An air flow system for a back fed common cavity oven wherein a path is provided for forcing moisture purging air into the cavity during microwave operation and wherein air is forced along the path during self-cleaning to prevent the very hot air in the cavity from flowing backwards along the path. Accordingly, parts and components along the path are not subjected to the very hot self-cleaning temperatures. The path may pass through the waveguide of the microwave feed apparatus and through an aperture into the cavity.

17 Claims, 8 Drawing Figures

AIR FLOW SYSTEM FOR COMMON CAVITY OVEN

BACKGROUND OF THE INVENTION

The general field of the invention relates to a common cavity electric and microwave oven and, more particularly, to such an oven having capability for self-cleaning by pyrolysis. Specifically, the invention relates to an air flow system for such an oven.

As is well known, it is desirable to force air through the cavity of a microwave oven to keep the moisture level in the cavity relatively low so that food surfaces will dry and so that moisture will not condense on the relatively cool walls of the cavity. It has been conventional to direct the magnetron blower air into the cavity through the waveguide. Not only is the waveguide a convenient entry port into the cavity but the air is frequently used to rotate a mode stirrer or primary radiating antenna positioned in or near the waveguide entrance to the cavity.

When electric heating elements are added to a microwave cavity to create what has been referred to as a "common cavity" oven, an open waveguide into the cavity can present problems. More specifically, hot air rises so that in a thermal only or self-cleaning mode when the magnetron blower is turned off, the hot air can rise into the waveguide unless its entry to the cavity is on or near the cavity floor. In fact, in prior art common cavity ovens, the microwave feed has been positioned on the floor of the cavity and, as would be expected, natural convection air flows up through the waveguide in thermal operation just as it flows in through the gap at the bottom of the door in electric only self-clean ovens. If the opening of the waveguide entrance were in the cavity at a location other than at the bottom, hot air flowing into the waveguide could overheat certain oven components such as, for example, plastic parts used to support the microwave antenna, power supply, magnetron blower, relays, etc. A typical self-clean temperature is approximately 900° F. and many plastic parts start to distort at approximately 400° F. Further, effluents such as grease from the food during thermal only operation and decomposition by-products during self-cleaning could tend to collect on or contaminate oven parts if an upward airflow path through the waveguide were permitted.

SUMMARY OF THE INVENTION

The invention defines a common cavity microwave and electric self-clean oven comprising an oven cavity having a port for directing air into the cavity, an electric heating element positioned in the cavity for providing thermal energy for cooking and for self-cleaning, a magnetron for energizing the cavity with microwave energy for cooking, a blower coupled to the port wherein at least a portion of air forced from the blower is directed through the port into the cavity, means for controlling the heating element, the magnetron, and the blower wherein the controlling means activates the blower when the magnetron is activated to remove moisture from the cavity and wherein the controlling means further activates the blower when the heating element is activated in a self-cleaning mode to resist hot air from the cavity flowing outwardly through the port. The port may preferably comprise a plurality of perforations in the back wall of the cavity so as to provide sealing for microwave energy. In an alternate embodiment, the air may flow into the cavity using the exact same path as the microwave energy thereby not requiring any microwave sealing means except at the waveguide. The blower air may also be used to cool the magnetron.

The invention may also be practiced by a common cavity microwave and electric self-clean oven comprising an oven cavity having a first port providing intake of air and a second port providing exhaust of air, an electric heating element positioned in the cavity for providing thermal energy for cooking and for self-cleaning, a magnetron for energizing the cavity with microwave energy for cooking, a blower coupled to the first port wherein at least a portion of air forced from the blower is directed through the first port into the cavity for a subsequent exhaust through the second port, and a controller for controlling activation of the heating element, the magnetron, and the blower, wherein the controller activates the blower when the magnetron is activated to remove moisture from the cavity and wherein the controller also activates the blower during self-cleaning to resist hot air flowing from the cavity outwardly through the first port.

The invention further defines a common cavity microwave and electric self-clean oven comprising an oven cavity defined by side walls, a back wall, a ceiling, a floor, and a door, the back wall having an aperture, a waveguide positioned behind the back wall and having one end communicating with the cavity through an aperture, a magnetron coupled to the opposite end of the waveguide for energizing it with microwave energy, means for coupling microwave energy from the waveguide through the aperture into the cavity for microwave cooking, an electric heating element positioned in the cavity for providing heat for thermal only cooking, for microwave combination cooking, and for self-cleaning the cavity by pyrolysis, a blower activated at least during the microwave cooking, the microwave combination cooking and the self-cleaning, and means for channeling at least a portion of the air forced from the blower at the magnetron and into the cavity via the waveguide wherein the blower is activated when the magnetron is activated to cool the magnetron and wherein the blower is activated during self-cleaning to resist hot air from flowing into the waveguide from the cavity. It may be preferable that the magnetron is positioned above the ceiling. It may also be preferable that the cavity have a recess in the back wall wherein the recess is at least partially separated from the remainder of the cavity by a microwave transparent cover, the coupling means being positioned in the recess, and the air forced from the blower being directed from the waveguide into the recess and into the cavity under the cover. In accordance with the defined structure, the microwave feed apparatus is positioned for back feed, thereby providing an oven that is particularly suited for mounting in a wall.

The invention further defines a common cavity microwave and electric self-clean oven comprising an oven cavity defined by side walls, a back wall, a ceiling, a floor and a door, the back wall having a recess separated from the remainder of the cavity by a microwave transparent cover except for a passageway between the bottom of the cover and the back wall, a waveguide having a first end behind the recess of the cavity and a second end extending upwardly above the ceiling, a magnetron coupled to the second end of the waveguide for exciting it with microwave energy, means for coupling the microwave energy from the waveguide into the recess, the coupling means comprising a metal probe extending through an aperture between the waveguide and the recess, a motor positioned behind the waveguide, the motor having a plastic drive shaft connected to the metal probe for rotating the probe, an electric heating element positioned in the cavity for providing thermal energy for thermal only cooking, for microwave combination cooking, and for self-cleaning by pyrolysis, an enclosure housing the magnetron, a blower for directing air into the magnetron enclosure wherein at least a portion of air forced into the enclosure is directed into the waveguide through a first plurality of perforations therein, the air from the waveguide being directed into the recess through a second plurality of perforations in the waveguide, a duct, and a third plurality of perforations in the recess, the air forced into the recess being directed through the passageway into the remainder of the cavity, and a controller for activating the magnetron, the heating element, and the blower, the controller activating the blower when the magnetron is activated to purge moisture from the cavity, the controller further activating the blower during self-cleaning to prevent hot air from flowing from the cavity into the waveguide via the third plurality of perforations, the duct, and the second plurality of perforations. It may be preferable that the passageway is formed by a plurality of bumps supporting the cover. The flow rate of the forced air into the cavity may preferably be in the range between one and two cubic feet per minute. Also, it may be preferable that the cover be mounted by a frame having a lip partially shielding the passageway. By partially shielding, it is generally meant that the air flowing through the passageway enters the cavity in a direction having a large vertical component.

The invention further may be practiced by the method of resisting during self-cleaning the flow of air from the common cavity of a combination microwave and electric oven through a port into a waveguide positioned behind the back wall of the cavity, the port being used during microwave cooking to force air into the cavity for purging moisture from the cavity, comprising the step of activating a blower to provide a flow of air from the waveguide through the port into the cavity.

BRIEF DESCRIPTION OF THE DRAWINGS

The objects and advantages described herein will be more fully understood by reading the Description of the Preferred Embodiment with reference to the drawings wherein.

DESCRIPTION OF THE PREFERRED EMBODIMENT

Figure 1:
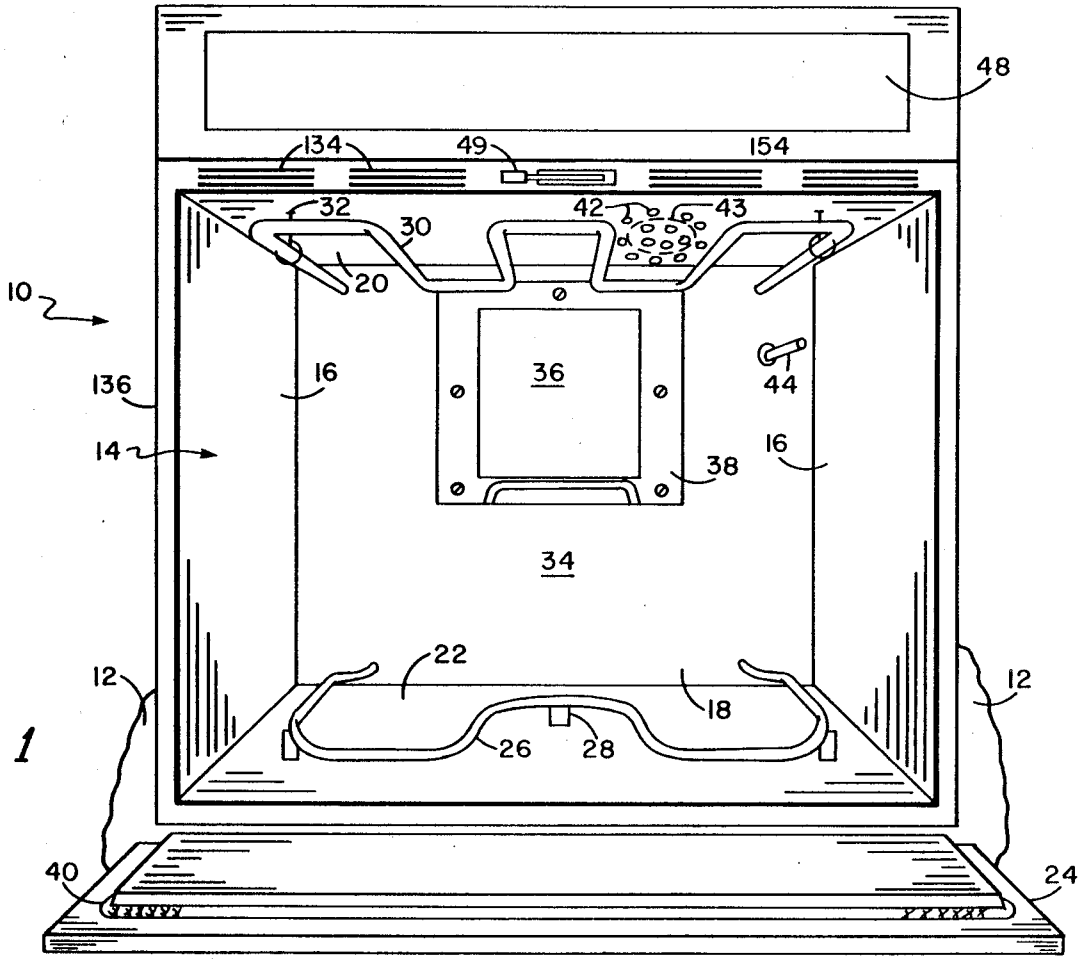
FIG. 1 is a perspective view of a wall oven.

Referring to FIG. 1, there is shown a perspective view of oven 10. Although oven 10 is here shown as a wall oven mounted in wall 12, those skilled in the art will understand that the advantages of the invention can also be practiced in a free standing range. Oven 10 has an oven cavity 14 in which food can be cooked by thermal energy alone, microwave energy alone, or a combination of microwave and thermal energy. Cavity 14 is defined by side walls 16, back wall 18, ceiling 20, floor 22, and door 24. Thermal energy is provided by conventional electric bake heating element 26 here shown supported horizontally adjacent to floor 22 by stands 28. Also, a conventional electric broil heating element 30 is suspended in a horizontal plane adjacent to ceiling 20 by bracket 32. In addition to electric heating elements 26 and/or 30 providing thermal energy for cooking, one or both of them are also used to heat cavity 14 to approximately 900° F. for self-cleaning by pyrolysis. As will be described in detail later herein, microwave energy can be coupled into the cooking region 34 of cavity 14 through microwave transparent cover 36 which is held in place by cover frame 38 on the back wall 18. Door 24 is provided with a choke 40 to prevent microwave energy from escaping cavity 14. Perforations 42 provide for exhaust of air from cavity 14 through smoke eliminator 43 as will be described in detail later herein. Temperature sensor 44 which may define a temperature bulb or thermocouple provides controller 46 (FIG. 8) with an indication of the cavity temperature for thermostatic action. Latch 49 can be used to lock door 24.

Figure 7:
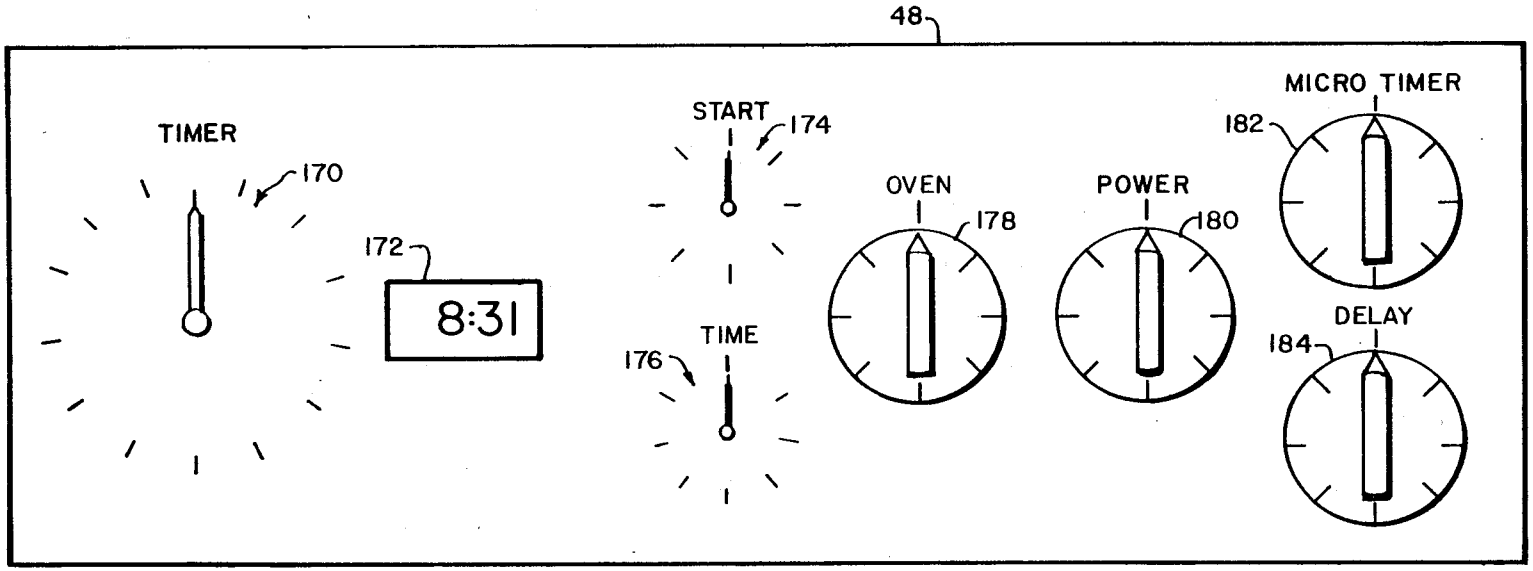
FIG. 7 shows the control panel.

Control panel 48, which will be described in detail later herein with reference to FIG. 7, is coupled to controller 46 and is used to input operator actuated commands.

Figure 2:
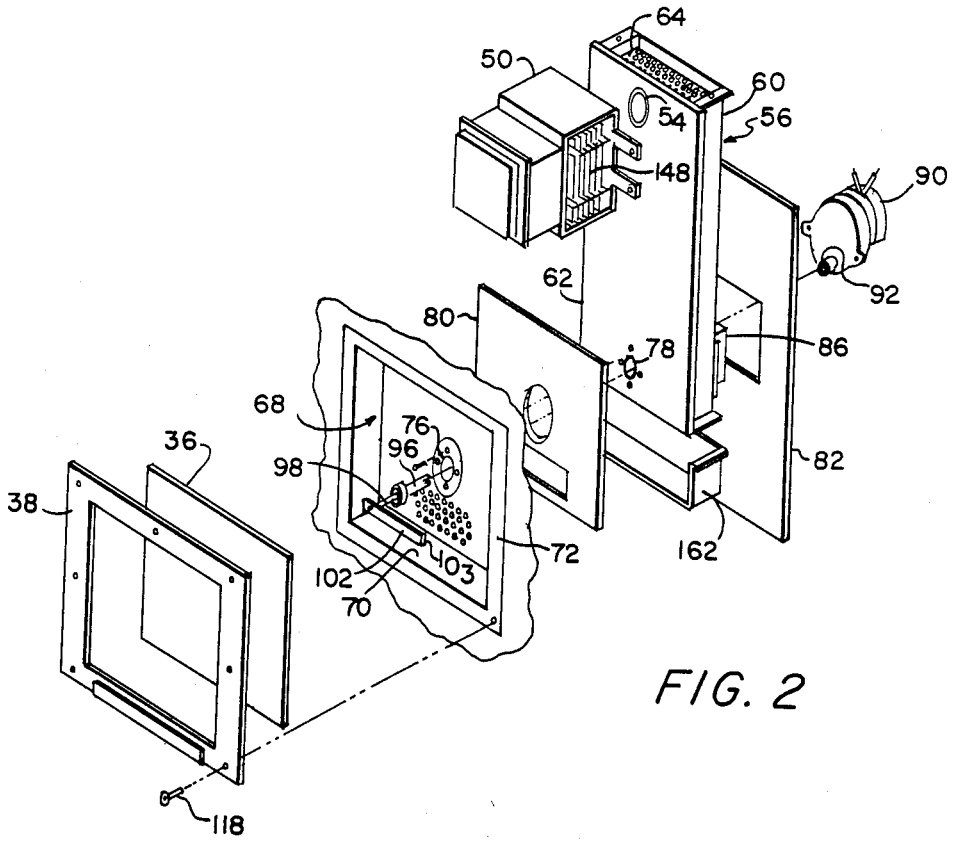
FIG. 2 is an exploded view of apparatus for energizing the oven with microwave energy.
Figure 3:
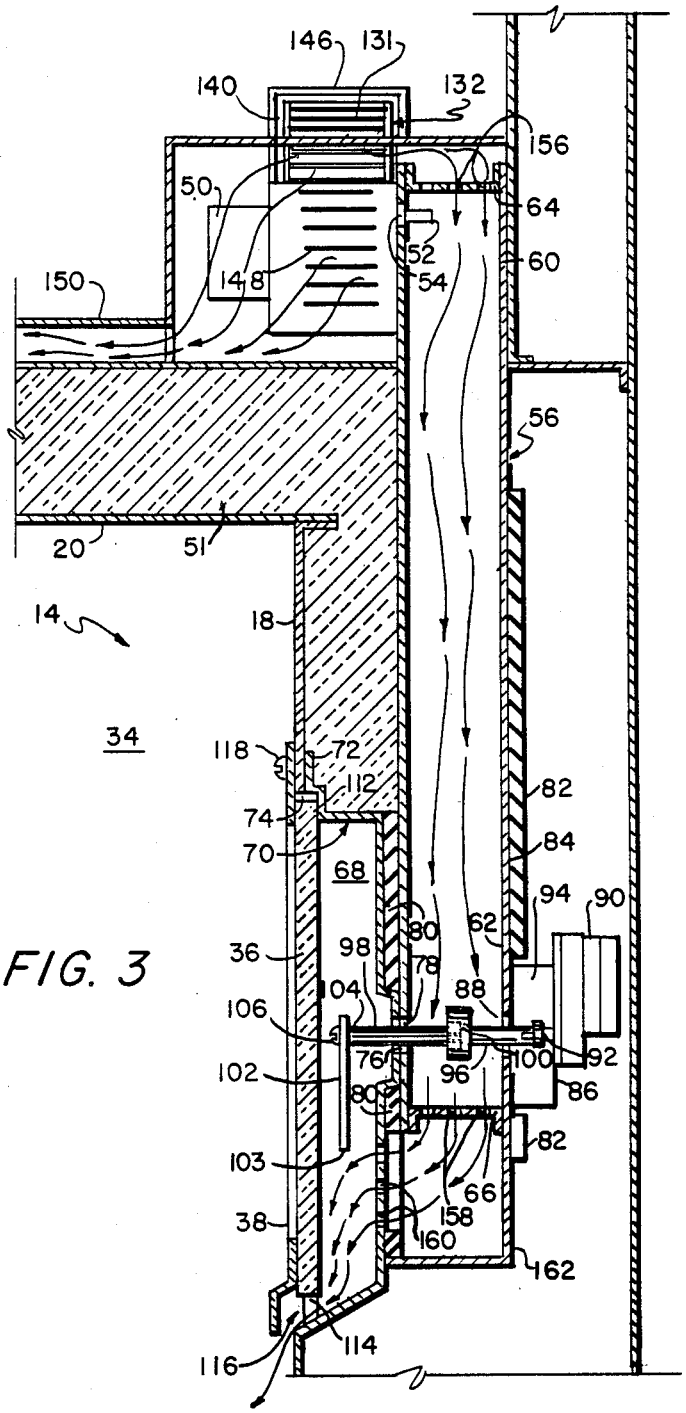
FIG. 3 is a side-sectioned view of the apparatus of FIG. 2 connected to the cavity.

Referring to FIG. 2, there is shown an exploded view of apparatus for exciting cavity 14 with microwave energy. FIG. 3 is a side-sectioned view of the apparatus of FIG. 2 connected to cavity 14. Magnetron 50 is positioned above insulation 51 adjacent cavity ceiling 20 and provides microwave energy having a frequency such as, for example, 2450 MHz. The output probe 52 of magnetron 50 is inserted through circular hole 54 in waveguide 56. In response to power supply 58 (FIG. 6) being activated, output probe 52 excites rectangular waveguide 56 with microwave energy which propagates from the source end 60 to the cavity feed end 62. Waveguide shorts 64 and 66 prevent microwave energy from escaping the ends of waveguide 56. Cavity 14 has a recess 68 in the back wall 18 formed by box 70 which preferably has a flange 72 which is welded around the perimeter of a cutout 74 in the back wall 18 of cavity 14. Also referring to FIGS. 4 and 5, there are shown expanded views of recess 68 with associated microwave feed apparatus partially broken away from the front and from the side, respectively. Box 70 and the cavity feed end 62 of waveguide 56 each have circular apertures 76 and 78, respectively, which align to each other. A thermal gasket 80 may preferably be seated between the corresponding surfaces of box 70 and waveguide 56 as shown. Also, thermal gasket 82 may preferably be secured to the back side 84 of waveguide 56.

A motor mounting bracket 86 is connected to the back side 84 of waveguide 56 and covers a hole 88 in waveguide 56 which aligns with circular apertures 76 and 78. Motor 90 has a shaft 92 which inserts through motor mounting bracket 86 into the space 94 defined between the back side 84 of waveguide 56 and motor mounting bracket 86. Connected to motor shaft 92 is a microwave transparent drive shaft 96 which extends into waveguide 56 through hole 88 and which may preferably be fabricated from a plastic such as Teflon. By being made of a microwave transparent material, drive shaft 96 does not serve as a center conductor for supporting microwave leakage through hole 88. It is preferable that the joint between drive shaft 96 and motor shaft 92 be readily disengageable by pulling drive shaft 96 forward so that disassembly can be executed from the front. Rod 98 is made of a metal such as aluminum and is rigidly connected by suitable means such as screwing drive shaft 96 into a threaded bore of rod 98. Rod 98 projects horizontally through circular apertures 76 and 78 into recess 68. A radiating finger or antenna 102 is connected to the recess end 104 of rod 98 by suitable means such as a bolt 106 which inserts through a hole in antenna 102 and is tightened down into a threaded bore in rod 98.

Still referring to FIGS. 2–5, box 70 has ledge 112 in which recess cover 36 seats. Cover 36 is made of a high temperature microwave transparent material such as Pyroceram so that it will freely pass microwave energy from recess 68 into cooking region 34 and will be resistant to self-cleaning temperatures. Cover 36, as described briefly earlier, is held firmly in place by metal cover frame 38 which defines a square border with a bottom section bent outwardly for reasons to be described subsequently. Frame 38 is secured to back wall 18 by suitable means, here screws 118 around its periphery.

As is well known, two design objectives of any microwave feed system are that it have optimum impedance matching for maximum power transfer and that it radiate energy into the cavity with a power distribution that provides relatively uniform heating of a variety of food types and geometries. In accordance with the description herein, a microwave feed system was built and it exhibited both of these design objectives. In fact, the microwave feed system even provided relatively uniform heating in low profile snacking cakes which was not possible with prior art back fed microwave ovens. All of the reasons for the improvement in heating uniformity may not be fully understood but an explanation including a discussion of the geometry and some of the dimensions of the feed apparatus is offered. First, according to well known principles, waveguide shorts 64 and 66 are precisely spaced from magnetron output probe 52 and rod 98, respectively, so as to provide an optimum coupling of microwave energy into waveguide 56 and into recess 68.

Figure 4:
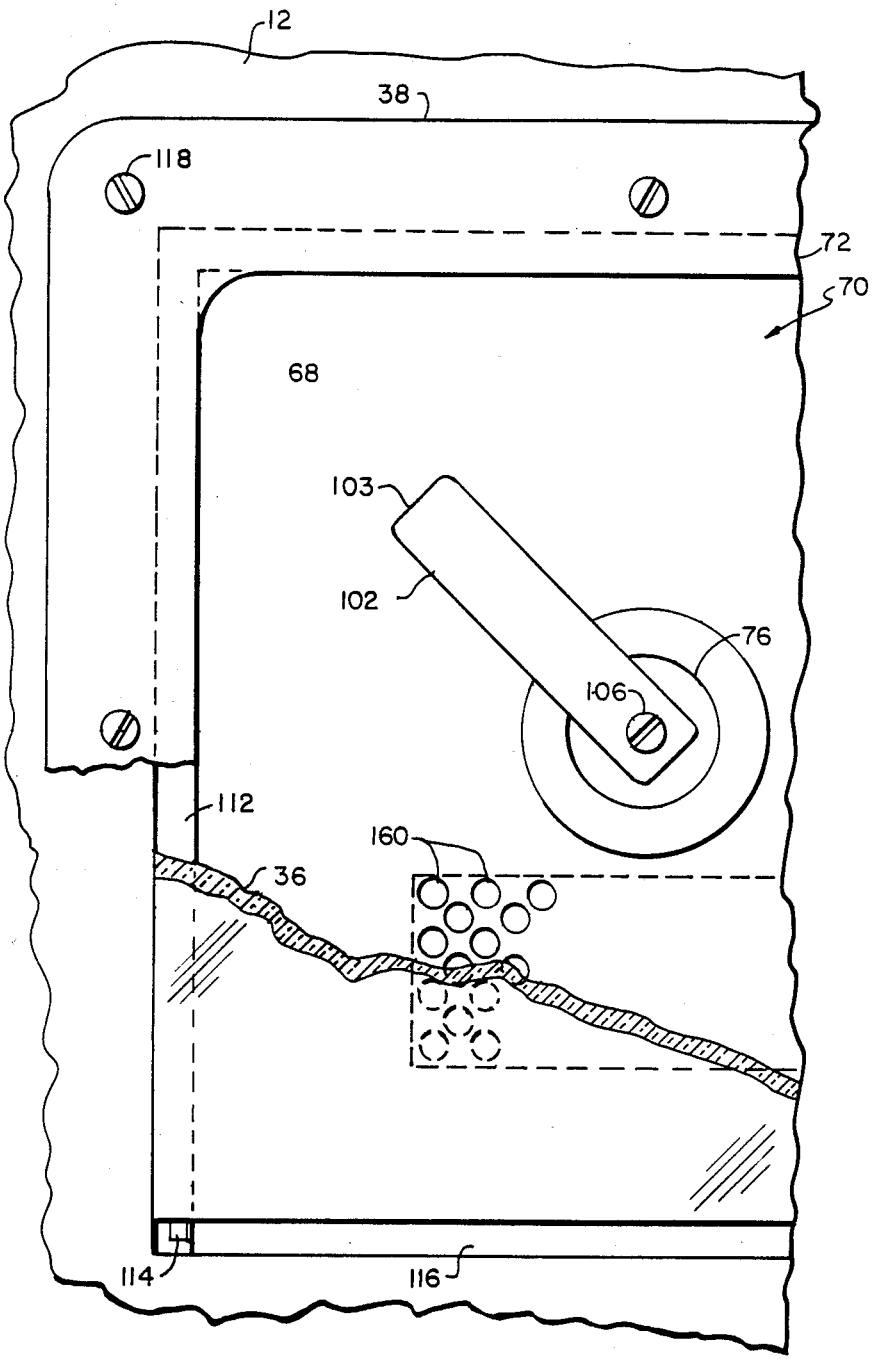
FIG. 4 is an expanded, partially broken away front view of the microwave feed box.
Figure 5:
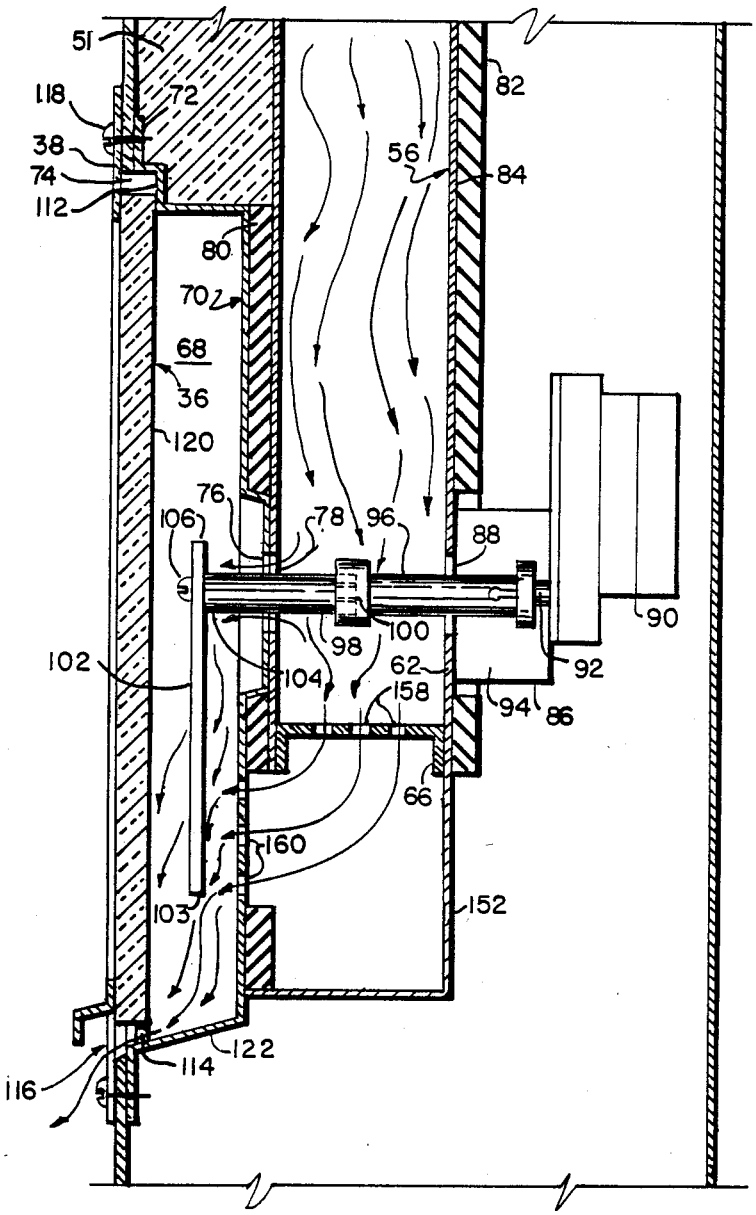
FIG. 5 is an expanded, sectioned side view of the microwave feed box.

Still referring to FIGS. 4 and 5, the entrance to box 70 is close to a square in shape having sides 6 inches by 6.5 inches surrounded by ledge 112 on the top and sides. The depth of box 70 is approximately 0.8 inches from ledge 112 or the rear surface 120 of cover 36. For reasons to be described later herein, the bottom wall 122 of box 70 is sloped downwardly. Pyroceram cover 36 has a thickness of approximately 0.15 inches and is slightly less than 6.5 inches square so that it seats on ledge 112. Radiating antenna 102 has an overall length of approximately 2.45 inches and a radiating length from its connection to rod 98 of approximately 2.2 inches or substantially one-half of a wavelength at 2450 MHz. The width of radiating antenna 102 is slightly larger than one-half inch. Radiating antenna 102, which may preferably be aluminum, is spaced approximately $\frac{3}{8}$ of an inch from cover 36. Rod 98 has a length approximately 1.4 inches and may preferably have a capacitive hat 100. Accordingly, microwave energy couples to rod 98 which functions as a receiving probe antenna and a center conductor to radiating antenna 102. Most of the microwave radiation is from radiating antenna 102 because it is spaced approximately 0.5 inches from the back of box 70 which functions as a ground plane. Because box 70 is rectangular or approximately square, the distance and the coupling between the end 103 of radiating element 102 and the closest adjacent wall of the box varies as radiating antenna 102 rotates. Accordingly, it is believed that the direction of the pattern radiated into cavity 14 varies. It was found that with the particular embodiment described, the dielectric properties of cover 36 and its spaced relationship to radiating antenna 102 were important for impedance matching. For example, as described, the VSWR was 1.7:1 but with cover 36 removed, the VSWR was 5:1. It is also noted that because of the properties of cover 36, the effective electrical distance from the back of box 70 to the front of cover 36 is approximately one quarter of a free space wavelength.

Figure 6:
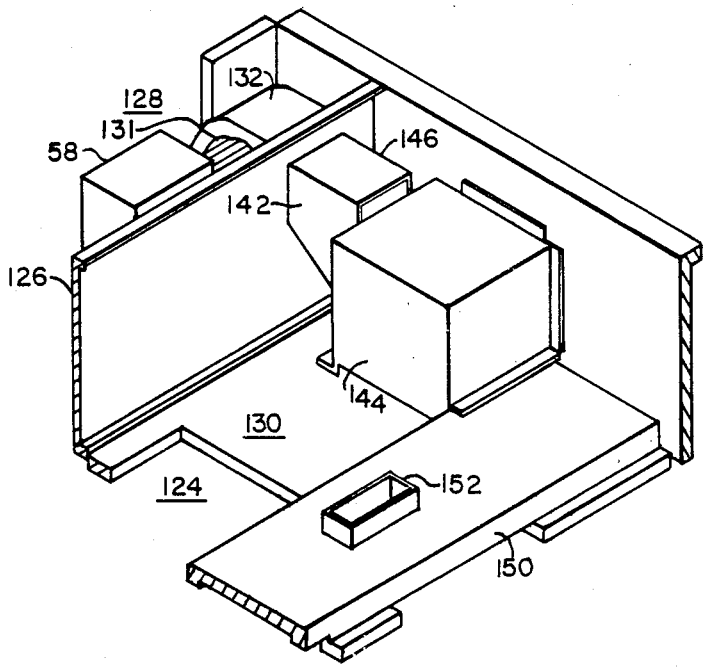
FIG. 6 shows part of the air flow system.

Turning now to the air flow system for oven 10 and referring to FIG. 6, a portion of the back part of control section 124 behind control panel 48 and above ceiling 20 is shown. Partition 126 separates the power supply and blower compartment 128 from the central compartment 130 in which magnetron 50 is positioned. When blower 132 is activated, as will be described in detail later herein, air is drawn into compartment 128 from front intake vent 134 and along side 136. The air passes across power supply 58 which typically consists of a transformer and other components (not shown) to provide cooling. The forced air expelled from blower 132 is directed through an opening 140 in partition 126 into chute 142 which leads to an enclosure 144 surrounding magnetron 50 as shown in FIG. 3. The upper portion 146 of chute 142 may preferably be open directing a portion of the forced air into central compartment 130. A sufficient amount of the forced air that enters magnetron enclosure 144 passes through the fins 148 of magnetron 50 to provide adequate cooling when magnetron 50 is activated. Air exhausts magnetron enclosure 144 through two different paths. The first path flows into flue duct 150 as indicated by the arrows in FIG. 3. The flue duct 150 leads to exhaust vent 154 on the right front of oven 10 above door 24. Duct 152 will be described later herein.

The second air flow path from magnetron enclosure 144 is through perforations 156 in waveguide short 64 into waveguide 56 as shown in FIG. 3. Perforations 156 and all the other air flow perforations are small enough so as to be below microwave cutoff and therefore prevent microwave energy from passing therethrough. The forced air in waveguide 56 passes past magnetron output probe 52 providing some cooling thereof and then out perforations 158 in waveguide short 66. Some of the forced air may also exit waveguide 56 along rod 98 through circular apertures 76 and 78 into recess 68. The air exhausting waveguide 56 through perforations 158 also enters recess 68 as it is directed through duct 162 and perforations 160 which function as an air input port to cavity 14. The forced air passes from recess 68 into the cooking region 34 of cavity 14 via passageway 116 under cover 36. More specifically, the bottom side of box 70 slopes downwardly and has indents or bumps 114 which support cover 36 approximately one quarter inch above the bottom entrance into box 70. Accordingly, an air flow path of approximately one quarter inch by 6 inches is provided from recess 68 into the cooking region 34 of cavity 14. The bottom branch of frame 38 is bent outwardly so as to shield but not impede this described flow of air. Convection air being forced into cavity 14 causes exhaust of air through perforations 42 in the top front of cavity 14. Above perforations 42 is smoke eliminator 43. The air then flows into flue duct 150 to exhaust vent 154. As an alternate embodiment, if the option is available during installation, the exhausting air may bypass duct 150 and flow through duct 152 into an outdoor flue.

Referring to FIG. 7, control panel 48 is shown. Although the controls to be described are shown with mechanical dials, it is understood that controller 46 could be a digital electronic controller or microprocessor in which case, the controls would typically be touch pad switches that are numerically or functionally labeled. TIMER control 170 can be used to set a particular time duration and, after that duration has elapsed, an audible alarm is sounded. CLOCK 172 displays the time of day. START control 174 can be used to commence the selected cooking mode or cleaning at a future time. TIME control 176 can be used to set the duration of the cooking mode or cleaning. Accordingly, using START control 174 and TIME control 176, the operator can set oven 10 to turn on at a preset time and then cook for a specified time duration after which the oven turns off. OVEN control 178 sets the mode of bake heating element 26 and broil heating element 30 to bake, broil, or clean. For example, if OVEN control 178 is set to a particular temperature, bake heating element 26 comes on until cavity 14 reaches that temperature and then bake heating element 26 is cycled on and off in response to cavity temperature sensor 44 to maintain the selected cavity temperature. Broil heating element 30 may also be used in the bake mode of operation; in this case, it may be preferable to activate broil heating element 30 at a reduced voltage such as, for example, 120 volts AC instead of 240 volts AC. In broil mode, only broil heating element 30 is activated. In clean mode, bake heating element 26 and preferably broil heating element 30 are activated. In self-clean, the temperature of cavity 14 is raised to a self-clean temperature such as, for example, 900° F. and then maintained at that temperature for two or three hours to degrade the oven soils by pyrolysis. POWER control 180 is used to set the microwave power level such as in the range from 20% to 100%. MICRO TIMER control 182 is used to set the time duration of microwave exposure. DELAY control 184 can be used to delay the commencement of the activation of magnetron 50 so that, if using combination cooking, the microwave cooking can be delayed into the thermal cooking cycle, if desired.

Figure 8:
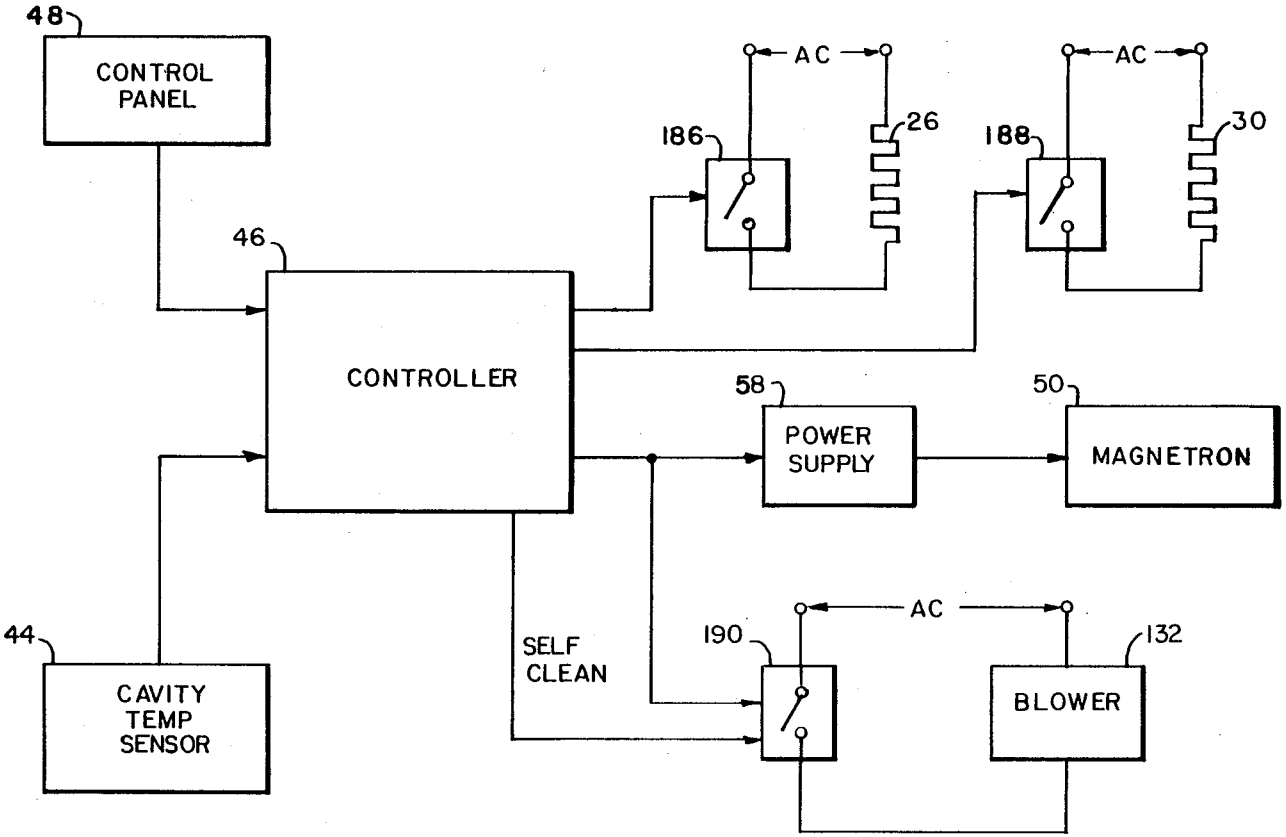
FIG. 8 is a schematic diagram of the control for the oven.

Referring to FIG. 8, a schematic diagram of the control circuit for oven 10 is shown. Control panel 48 and cavity temperature sensor 44 are both shown providing inputs to controller 46. The functions described herein with regard to controller 46 could be provided by a conventional electromechanical oven controller or a digital electronic controller. In response to an operator actuated control or command from control panel 48, controller 46 activates relays 186 and 188 to turn on bake heating element 26 or broil heating element 30, respectively, as appropriate. The AC voltage applied across bake heating element 26 and broil heating element 30 may preferably be either 120 volts or 240 volts as is desirable for the particular operational task. In response to MICRO TIMER control 182, controller 46 turns on magnetron 50 by activating power supply 58. As described, the basic modes of operation are BAKE only which may activate broil heating element 30 in addition to bake heating element 26, BROIL only, MICRO only, COMBINATION using microwave plus thermal, and SELF-CLEAN. Anytime magnetron 50 is turned on, controller 46 closes relay 190 to activate blower 132 which is required to cool magnetron 50. Also, controller 46 closes relay 190 to activate blower 132 in the self-clean mode so as to provide a flow of air from recess 68 into the cooking region 34 of cavity 14 through passageway 116 as described in order to resist the extremely hot self-cleaning air from flowing into waveguide 56 where plastic drive shaft 96 is positioned. If the extremely hot self-cleaning air were permitted to flow up waveguide 56, it could damage other parts and components such as electronics, motor 90, and the impeller 131 of blower 132. In an alternate embodiment, the closing of relay 190 could be controlled by the closing of latch 49 which must be locked to initiate either microwave or self-cleaning operation. Also, the closing of relay 190 for self-clean operation could be initiated by a thermostat set at some temperature such as, for example, 500° F. Further, although blower 132 is shown being activated by microwave operation or self-clean, it may also be preferable that blower 132 be activated for all thermal operation including bake and broil. The capacity of blower 132 and the constrictions of perforations 156, 158, 160 and 42 and the constrictions of passageway 116 and the smoke eliminator 43 should be such that during self-cleaning, air flows down waveguide into cavity 14. For this purpose, 0.5 CFM may be sufficient. However, in order to improve ventilation during microwave operation, it may be preferable that the flow rate be in the range from 1–3 CFM or more preferably, in the range from 1–2 CFM. As an alternate embodiment, the speed of blower 132 could be varied to optimize the air flow rates for different operational modes. If more air were forced into cavity 14 during self-clean, it could make it difficult or inefficient to reach and maintain self-cleaning temperatures. Also, because smoke eliminator 43 at the output of cavity 14 may be the smallest constriction in the overall air flow path, if more air were forced into cavity 14, it could create a positive pressure sufficient to force self-clean decomposition by-products out around door 24. So called "auto-ignition" is a phenomenon that occurs during self-cleaning if, as a result of degradation of soils, a combustible substance is present in the cavity and the temperature and oxygen levels are sufficient to ignite it. Following auto-ignition, there is a brief but dramatic increase in pressure which may, for example, be on the order of ten pounds per square inch above atmospheric. Obviously, the air flow down waveguide 56, as described herein, would be briefly interrupted because the flow would be totally insufficient to prevent degradation products from flowing into waveguide 56. The backward flow, however, has such a short duration that temperature sensitive parts such as drive shaft 96 are not damaged.

This concludes the description of the preferred embodiment. The reading of it by those skilled in the art will bring to mind many alterations and modifications without departing from the spirit and scope of the invention. Accordingly, it is intended that the scope of the invention be limited only by the appended claims.

What is claimed is:

1. A common cavity microwave and electric self-clean oven, comprising:

an oven cavity having a port for directing air into said cavity;

an electric heating element positioned in said cavity for providing thermal energy for cooking and for self-cleaning;

a magnetron for energizing said cavity with microwave energy for cooking;

a blower coupled to said port wherein at least a portion of air forced from said blower is directed through said port into said cavity;

means for controlling said heating element, said magnetron, and said blower, wherein said controlling means activates said blower when said magnetron is activated to remove moisture from said cavity; and wherein said controlling means also activates said blower when said heating element is activated in a self-cleaning mode to resist hot air from said cavity flowing outwardly through said port.

2. The oven recited in claim 1 wherein said port comprises a plurality of perforations in the back wall of said cavity.

3. The oven recited in claim 1 wherein a portion of said air forced from said blower directed over said magnetron for cooling.

4. A common cavity microwave and electric self-clean oven comprising:

an oven cavity having a first port providing intake of air and a second port providing exhaust of air;

an electric heating element positioned in said cavity for providing thermal energy for cooking and for self-cleaning;

a magnetron for energizing said cavity with microwave energy for cooking;

a blower coupled to said first port wherein at least a portion of air forced from said blower is directed through said first port into said cavity for subsequent exhaust from said cavity through said second port; and a controller for controlling activation of said heating element, said magnetron, and said blower, said controller activating said blower when said magnetron is activated to remove moisture from said cavity, said controller also activating said blower during said self-cleaning to resist hot air flowing from said cavity outwardly through said first port.

5. The ovenb recited in claim 4 wherein each of said first and second ports comprises a set of perforations dimensioned to seal against the passage of microwave energy from said cavity.

6. The oven recited in claim 4 further comprising a second heating element also controlled by said controller.

7. The oven recited in claim 4 wherein at least the portion of said air forced from said blower is directed at said magnetron for cooling.

8. A common cavity microwave and electric self-clean oven, comprising:

an oven cavity defined by side walls, a back wall, a ceiling, a floor, and a door;

said back wall having an aperture;

a waveguide positioned behind said back wall and having one end communicating with said cavity through said aperture;

a magnetron coupled to the opposite end of said waveguide for energizing said waveguide with microwave energy;

means for coupling microwave energy from said waveguide through said aperture into said cavity for microwave cooking;

an electric heating element positioned in said cavity for providing heat for thermal only cooking, for microwave combination cooking, and for self-cleaning said cavity by pyrolysis;

a blower activated at least during said microwave cooking, said microwave combination cooking and said self-cleaning; and means for channeling at least a portion of the air forced from said blower at said magnetron and into said cavity via said waveguide wherein said blower is activated when said magnetron is activated to cool said magnetron and wherein said blower is activated during self-cleaning to resist hot air from flowing into said waveguide from said cavity.

9. The oven recited in claim 8 wherein said magnetron is positioned above said ceiling.

10. The oven recited in claim 8 wherein said cavity has a recess in said back wall, said recess being at least partially separated from the remainder of said cavity by a microwave transparent cover, said coupling means being positioned in said recess, and said air forced from said blower being directed from said waveguide into said recess and into said cavity under said cover.

11. A common cavity microwave and electric self-clean oven, comprising:

an oven cavity defined by side walls, a back wall, a ceiling, a floor and a door;

said back wall having a recess separated from the remainder of said cavity by a microwave transparent cover except for a passageway between the bottom of said cover and said back wall;

a waveguide having a first end behind said recess of said cavity and a second end extending upwardly above said ceiling;

a magnetron coupled to said second end of said waveguide for exciting it with microwave energy;

means for coupling said microwave energy from said waveguide into said recess, said coupling means comprising a metal probe extending through an aperture between said waveguide and said recess;

a motor positioned behind said waveguide, said motor having a plastic drive shaft connected to said metal probe for rotating said probe;

an electric heating element positioned in said cavity for providing thermal energy for thermal only cooking, for microwave combination cooking, and for self-cleaning by pyrolysis;

an enclosure housing said magnetron;

a blower for directing air into said magnetron enclosure wherein at least a portion of air forced into said enclosure is directed into said waveguide through a first plurality of perforations therein, said air from said wave-guide being directed into said recess through a second plurality of perforations in said waveguide, a duct, and a third plurality of perforations in said recess, said air forced into said recess being directed through said passageway into said remainder of said cavity; and a controller for activating said magnetron, said heating element, and said blower, said controller activating said blower when said magnetron is activated to purge moisture from said cavity, said controller further activating said blower during self-cleaning to prevent hot air from flowing from said cavity into said waveguide via said third plurality of perforations, said duct, and said second plurality of perforations.

12. The oven recited in claim 11 further comprising a second heating element positioned in said cavity and activated by said controller.

13. The oven recited in claim 11 further comprising a cavity temperature sensor coupled to said controller for limiting the temperature of said self-cleaning.

14. The oven recited in claim 11 wherein said passageway is formed by a plurality of bumps supporting said cover.

15. The oven recited in claim 11 wherein the flow rate of said forced air into said cavity is in the range between one and two cubic feet per minute.

16. The oven recited in claim 11 wherein said cover is mounted by a frame having a lip partially shielding said passageway.

17. The method of resisting during self-cleaning the flow of air from the common cavity of a combination microwave and electric oven through a port into a waveguide positioned behind the back wall of said cavity, said port being used during microwave cooking to force air into said cavity for purging moisture from said cavity, comprising the step of:

activating a blower to provide a flow of air from said waveguide through said port into said cavity.

* * * * *